US009635470B2

(12) United States Patent
Solum

(10) Patent No.: US 9,635,470 B2
(45) **Date of Patent: *Apr. 25, 2017**

(54) METHOD AND APPARATUS FOR MONITORING WIRELESS COMMUNICATION IN HEARING ASSISTANCE SYSTEMS

(71) Applicant: Starkey Laboratories, Inc., Eden Prairie, MN (US)

(72) Inventor: Jeffrey Paul Solum, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 96 days.

This patent is subject to a terminal disclaimer.

(21) Appl. No.: 14/262,983

(22) Filed: Apr. 28, 2014

(65) Prior Publication Data

US 2015/0023513 A1 Jan. 22, 2015

Related U.S. Application Data

(63) Continuation of application No. 13/253,550, filed on Oct. 5, 2011, now Pat. No. 8,712,083.

(60) Provisional application No. 61/391,869, filed on Oct. 11, 2010.

(51) Int. Cl.

| | |
|---|---|
| ***H04R 29/00*** | (2006.01) |
| ***H04R 25/00*** | (2006.01) |
| *H04R 1/02* | (2006.01) |

(52) U.S. Cl.

CPC ..... *H04R 25/30* (2013.01); *H04R 25/554* (2013.01); *H04R 25/552* (2013.01); *H04R 2225/39* (2013.01); *H04R 2225/55* (2013.01)

(58) Field of Classification Search

CPC ..... H04R 2225/55
USPC ..... 381/60, 312–324; 600/25; 370/310
See application file for complete search history.

(56) References Cited

U.S. PATENT DOCUMENTS

| | | | |
|---|---|---|---|
| 5,479,522 | A | 12/1995 | Lindemann et al. |
| 5,734,976 | A | 3/1998 | Bartschi et al. |
| 5,757,932 | A | 5/1998 | Lindemann et al. |
| 5,966,639 | A | 10/1999 | Goldberg et al. |
| 6,078,825 | A | 6/2000 | Hahn et al. |
| 6,088,339 | A | 7/2000 | Meyer |

(Continued)

FOREIGN PATENT DOCUMENTS

| | | |
|---|---|---|
| CH | 673551 A5 | 3/1990 |
| CN | 1191060 A | 8/1998 |

(Continued)

OTHER PUBLICATIONS

"U.S. Appl. No. 13/970,368, Preliminary Amendment mailed Mar. 6, 2014", (Mar. 6, 2014), 6 pgs.

(Continued)

*Primary Examiner* — Sunita Joshi
(74) *Attorney, Agent, or Firm* — Schwegman, Lundberg & Woessner, P.A.

(57) ABSTRACT

A system collects information on performance of short-range wireless communication in local hearing aid systems. The information is analyzed, for example, to inform local users to adjust the local hearing aid systems, to adjust operational parameters for improving wireless communication in the local hearing aid systems, and/or to improve wireless connectivity and reliability in future products.

20 Claims, 5 Drawing Sheets

(56) References Cited

U.S. PATENT DOCUMENTS

| | | | | |
|---|---|---|---|---|
| 6,144,748 | A | 11/2000 | Kerns | |
| 6,633,645 | B2 | 10/2003 | Bren et al. | |
| 6,694,034 | B2 | 2/2004 | Julstrom et al. | |
| 7,062,223 | B2 | 6/2006 | Gerber et al. | |
| 7,181,032 | B2 | 2/2007 | Jakob et al. | |
| 7,257,372 | B2 | 8/2007 | Kaltenbach et al. | |
| 7,412,294 | B1 | 8/2008 | Woolfork | |
| 7,778,432 | B2 | 8/2010 | Larsen | |
| 7,813,762 | B2 | 10/2010 | Sanguino et al. | |
| 8,041,066 | B2 | 10/2011 | Solum | |
| 8,169,938 | B2 | 5/2012 | Duchscher et al. | |
| 8,194,901 | B2 | 6/2012 | Alber et al. | |
| 8,515,114 | B2 | 8/2013 | Solum | |
| 8,712,083 | B2 | 4/2014 | Solum | |
| 2002/0030871 | A1 | 3/2002 | Anderson et al. | |
| 2003/0045283 | A1 | 3/2003 | Hagedoorn | |
| 2003/0059073 | A1 | 3/2003 | Bren et al. | |
| 2003/0133582 | A1 | 7/2003 | Niederdrank | |
| 2003/0215106 | A1 | 11/2003 | Hagen et al. | |
| 2004/0052391 | A1 | 3/2004 | Bren et al. | |
| 2004/0077387 | A1 | 4/2004 | Sayag et al. | |
| 2004/0136555 | A1 | 7/2004 | Enzmann | |
| 2004/0141628 | A1 | 7/2004 | Villaverde et al. | |
| 2004/0190739 | A1 | 9/2004 | Bachler et al. | |
| 2004/0259585 | A1 | 12/2004 | Yitzchak et al. | |
| 2005/0008178 | A1 | 1/2005 | Joergensen et al. | |
| 2005/0100182 | A1 | 5/2005 | Sykes et al. | |
| 2005/0160270 | A1 | 7/2005 | Goldberg et al. | |
| 2005/0197061 | A1 | 9/2005 | Hundal | |
| 2005/0283263 | A1* | 12/2005 | Eaton | H04R 25/554 700/94 |
| 2006/0068842 | A1 | 3/2006 | Sanguino et al. | |
| 2006/0093172 | A1 | 5/2006 | Ludvigsen et al. | |
| 2006/0193273 | A1 | 8/2006 | Passier et al. | |
| 2006/0205349 | A1 | 9/2006 | Passier et al. | |
| 2006/0245611 | A1 | 11/2006 | Jorgensen et al. | |
| 2006/0274747 | A1* | 12/2006 | Duchscher | H04L 1/0057 370/389 |
| 2007/0009124 | A1* | 1/2007 | Larsen | H04R 25/554 381/315 |
| 2007/0066297 | A1 | 3/2007 | Heidari-bateni | |
| 2007/0149261 | A1 | 6/2007 | Huddart | |
| 2008/0159548 | A1* | 7/2008 | Solum | H04S 1/007 381/58 |
| 2010/0148931 | A1 | 6/2010 | Pappu et al. | |
| 2011/0090837 | A1 | 4/2011 | Duchscher et al. | |
| 2011/0150255 | A1 | 6/2011 | Solum | |
| 2012/0121094 | A1 | 5/2012 | Solum | |
| 2012/0177235 | A1 | 7/2012 | Solum | |
| 2013/0004002 | A1 | 1/2013 | Duchscher et al. | |
| 2014/0177885 | A1 | 6/2014 | Solum | |

FOREIGN PATENT DOCUMENTS

| | | | |
|---|---|---|---|
| CN | 101233786 | B | 5/2013 |
| EP | 1185138 | A2 | 3/2002 |
| EP | 1445982 | A1 | 8/2004 |
| EP | 1519625 | A2 | 3/2005 |
| EP | 1531650 | A2 | 5/2005 |
| EP | 1670283 | A1 | 6/2006 |
| EP | 1715718 | A2 | 10/2006 |
| KR | 101253799 | B1 | 4/2013 |
| WO | WO-9641498 | A1 | 12/1996 |
| WO | WO-0022874 | A2 | 4/2000 |
| WO | WO-0167433 | A1 | 9/2001 |
| WO | WO-0209363 | A2 | 1/2002 |
| WO | WO-2004034738 | A1 | 4/2004 |
| WO | WO-2004100607 | A1 | 11/2004 |
| WO | WO-2004110099 | A2 | 12/2004 |
| WO | WO-2005101731 | A2 | 10/2005 |
| WO | WO-2006023920 | A1 | 3/2006 |
| WO | WO-2006074655 | A1 | 7/2006 |
| WO | WO-2006133158 | A1 | 12/2006 |
| WO | WO-2007068243 | A1 | 6/2007 |
| WO | WO-2009063097 | A2 | 5/2009 |

OTHER PUBLICATIONS

"European Application Serial No. 05791651.2, Examiner Interview Summary mailed Mar. 28, 2012", (Mar. 28, 2012), 4 pgs.
"European Application Serial No. 05791651.2, Oral Proceedings mailed May 3, 2012", (May 3, 2012), 3 pgs.
"European Application Serial No. 05791651.2, Written Decision to Refuse mailed May 3, 2012", (May 3, 2012), 17 pgs.
"European Application Serial No. 05791651.2, Written Submission filed Mar. 16, 2012", (Mar. 16, 2012), 51 pgs.
"European Application Serial No. 07254947.0, Summons to Attend Oral Proceedings mailed Nov. 7, 2014", 3 pgs.
"European Application Serial No. 11184383.5 , Summons to Attend Oral Proceedings mailed Aug. 29, 2013", (Aug. 29, 2013), 5 pgs.
"Korean Application Serial No. 10-2008-7000332, Voluntary Amendment filed Jun. 9, 2011", 20 pgs.
"U.S. Appl. No. 11/207,591, Final Office Action mailed Jan. 6, 2009", 13 pgs.
"U.S. Appl. No. 11/207,591, Final Office Action mailed Jan. 15, 2010", 13 pgs.
"U.S. Appl. No. 11/207,591, Non-Final Office Action mailed Jul. 14, 2009", 13 pgs.
"U.S. Appl. No. 11/207,591, Non-Final Office Action mailed Jul. 28, 2008", 11 pgs.
"U.S. Appl. No. 11/207,591, Non-Final Office Action mailed Nov. 16, 2007", 9 pgs.
"U.S. Appl. No. 11/207,591, Response filed May 6, 2008 to Non Final Office Action mailed Nov. 16, 2007", 8 pgs.
"U.S. Appl. No. 11/207,591, Response filed May 6, 2009 to Final Office Action mailed Jan. 6, 2009", 8 pgs.
"U.S. Appl. No. 11/207,591, Response filed Oct. 14, 2009 to Non Final Office Action mailed Jul. 14, 2009", 10 pgs.
"U.S. Appl. No. 11/207,591, Response filed Oct. 28, 2008 to Non Final Office Action mailed Jul. 28, 2008", 7 pgs.
"U.S. Appl. No. 11/207,591, Notice of Allowance mailed Jul. 1, 2010", 7 pgs.
"U.S. Appl. No. 11/207,591, Response filed Jun. 15, 2010 to Final Office Action mailed Jan. 15, 2010", 9 pgs.
"U.S. Appl. No. 11/447,617, Final Office Action mailed Mar. 3, 2010", 31 pgs.
"U.S. Appl. No. 11/447,617, Non Final Office Action mailed Aug. 31, 2011", 29 pgs.
"U.S. Appl. No. 11/447,617, Non-Final Office Action mailed Jun. 22, 2009", 25 pgs.
"U.S. Appl. No. 11/447,617, Notice of Allowance mailed Mar. 16, 2012", 8 pgs.
"U.S. Appl. No. 11/447,617, Response filed Feb. 29, 2012 to Non Final Office Action mailed Aug. 31, 2011", 13 pgs.
"U.S. Appl. No. 11/447,617, Response filed May 26, 2009 to Restriction Requirement mailed Apr. 24, 2009", 8 pgs.
"U.S. Appl. No. 11/447,617, Response filed Aug. 3, 2010 to Final Office Action mailed Mar. 3, 2010", 14 pgs.
"U.S. Appl. No. 11/447,617, Response filed Nov. 23, 2009 to Non Final Office Action mailed Jun. 22, 2009", 15 pgs.
"U.S. Appl. No. 11/447,617, Restriction Requirement mailed Apr. 24, 2009", 6 pgs.
"U.S. Appl. No. 11/619,541, Non Final Office Action mailed Dec. 21, 2010", 7 pgs.
"U.S. Appl. No. 11/619,541, Notice of Allowance mailed Jul. 5, 2011", 6 pgs.
"U.S. Appl. No. 11/619,541, Response filed May 23, 2011 to Non Final Office Action mailed Dec. 21, 2010", 10 pgs.
"U.S. Appl. No. 12/980,696, Non Final Office Action mailed Apr. 20, 2011", 7 pgs.
"U.S. Appl. No. 13/253,550, Non Final Office Action mailed Aug. 8, 2013", 12 pgs.
"U.S. Appl. No. 13/253,550, Notice of Allowance mailed Dec. 11, 2013", 11 pgs.

(56) References Cited

OTHER PUBLICATIONS

"U.S. Appl. No. 13/253,550, Response filed Nov. 8, 2013 to Non Final Office Action mailed Aug. 8, 2013", 7 pgs.
"U.S. Appl. No. 13/270,860, Non Final Office Action mailed Dec. 18, 2012", 5 pgs.
"U.S. Appl. No. 13/270,860, Notice of Allowance mailed Apr. 17, 2013", 10 pgs.
"U.S. Appl. No. 13/270,860, Preliminary Amendment filed Jan. 27, 2012", 7 pgs.
"U.S. Appl. No. 13/270,860, Response filed Mar. 18, 2013 to Non Final Office Action mailed Dec. 18, 2012", 7 pgs.
"Chinese Application Serial No. 2,609,979, Response filed Aug. 16, 2011 to Office Action mailed Apr. 12, 2011", w/English claims, 15 pgs.
"Chinese Application Serial No. 200680028085.8, Office Action mailed Apr. 12, 2011", w/English translation, 3 pgs.
"Chinese Application Serial No. 200680028085.8, Office Action mailed Sep. 30, 2011", w/English translation, 8 pgs.
"Chinese Application Serial No. 200680028085.8, Office Action mailed Jun. 29, 2012", w/English translation, 8 pgs.
"Chinese Application Serial No. 200680028085.8, Response filed Apr. 13, 2012 to Office Action mailed Sep. 30, 2011", w/English claims, 15 pgs.
"Chinese Application Serial No. 200680028085.8, Response filed Nov. 14, 2012 to Office Action mailed Jun. 29, 2012", w/English claims, 14 pgs.
"European Application Serial No. 05791651.2, Office Action mailed Mar. 15, 2011", 5 pgs.
"European Application Serial No. 06772250.4, Office Action mailed Oct. 18, 2012", 5 pgs.
"European Application Serial No. 05791651.2, Office Action Response Filed Jul. 7, 2011", 11 pgs.
"European Application Serial No. 05791651.2, Summons to Attend Oral Proceedings mailed Jan. 20, 2012", 4 pgs.
"European Application Serial No. 06772250.4, Office Action mailed Dec. 22, 2010", 3 pgs.
"European Application Serial No. 06772250.4, Response filed Apr. 25, 2013 to Office Action mailed Oct. 18, 2012", 7 pgs.
"European Application Serial No. 06772250.4, Response filed Jun. 24, 2011 to Office Action mailed Dec. 22, 2010", 18 pgs.
"European Application Serial No. 07254947.0, Extended European Search Report mailed Apr. 3, 2008", 6 pgs.
"European Application Serial No. 07254947.0, Office Action mailed Aug. 25, 2008", 1 pgs.
"European Application Serial No. 07254947.0, Office Action mailed Jan. 19, 2012", 5 pgs.
"European Application Serial No. 07254947.0, Office Action mailed Oct. 12, 2010", 4 pgs.
"European Application Serial No. 07254947.0, Response filed Apr. 26, 2011 to Official Communication mailed Oct. 12, 2010", 11 pgs.
"European Application Serial No. 07254947.0, Response filed Jul. 20, 2012 to Examination Notification Art. 94(3) mailed Jan. 19, 2012", 9 pgs.
"European Application Serial No. 07254947.0, Response filed Feb. 28, 2009 to Official Communication mailed Aug. 25, 2008", 2 pgs.
"European Application Serial No. 11184383.5, Extended European Search Report mailed Jul. 31, 2012", 7 pgs.
"European Application Serial No. 11184383.5, Office Action mailed Mar. 8, 2013", 7 pgs.
"European Application Serial No. 11184383.5, Response filed Feb. 14, 2013 to Extended European Search Report mailed Jul. 31, 2012", 23 pgs.
"European Application Serial No. 11184383.5, Response filed Jul. 12, 2013 to Office Action mailed Mar. 8, 2013", 11 pgs.
"European Application Serial No. 11184383.5, Summons to Attend Oral Proceedings mailed Aug. 29, 2013", 5 pgs.
"European Application Serial No. 13150071.2, Extended European Search Report mailed Feb. 15, 2013", 7 pgs.
"European Application Serial No. 13150071.2, Response filed Oct. 17, 2013 to Extended European Search Report mailed Feb. 15, 2013", 23 pgs.
"International Application Serial No. PCT/US2005/029971, International Preliminary Report on Patentability mailed Mar. 1, 2007", 6 pgs.
"International Application Serial No. PCT/US2005/029971, International Search Report mailed Jan. 5, 2006", 7 pgs.
"International Application Serial No. PCT/US2005/029971, Written Opinion mailed Jan. 5, 2006", 4 pgs.
"International Application Serial No. PCT/US2006/021870, International Preliminary Report on Patentability mailed Dec. 6, 2007", 8 pgs.
"International Application Serial No. PCT/US2006/021870, International Search Report and Written Opinion mailed Nov. 3, 2006", 13 pgs.
"Kleer Announces Reference Design for Wireless Earphones", [Online]. Retrieved from the Internet: <URL:http://kleer.com/newsevents/press_releases/prjan2.php>, (Jan. 2, 2007), 2 pgs.
"Korean Application Serial No. 10-2008-7000332, Office Action mailed Aug. 15, 2012", w/English translation, 9 pgs.
"Korean Application Serial No. 10-2008-7000332, Response filed Oct. 15, 2012 to Office Action mailed Aug. 15, 2012", w/English claims, 22 pgs.
"U.S. Appl. No. 13/458,304, Non Final Office Action mailed Mar. 3, 2015", 9 pgs.
"U.S. Appl. No. 13/458,304, Response filed Jul. 6, 2015 to Non Final Office Action mailed Mar. 3, 2015", 7 pgs.
"U.S. Appl. No. 13/970,368, Non Final Office Action mailed Jun. 17, 2015", 6 pgs.
"U.S. Appl. No. 13/970,368, Notice of Allowance mailed Oct. 29, 2015", 9 pgs.
"U.S. Appl. No. 13/970,368, Response filed Sep. 16, 2015 to Non Final Office Action mailed Jul. 17, 2015", 15 pgs.
"European Application Serial No. 06772250.4, Communication Pursuant to Article 94(3) EPC mailed Sep. 17, 2015", 5 pgs.

* cited by examiner

METHOD AND APPARATUS FOR MONITORING WIRELESS COMMUNICATION IN HEARING ASSISTANCE SYSTEMS

RELATED APPLICATION

This application is a continuation of U.S. application Ser. No. 13/253,550, filed 5 Oct. 2011, which application claims the benefit under 35 U.S.C. 119(e) of U.S. Provisional Patent Application Ser. No. 61/391,869, filed on 11 Oct. 2010, which applications are incorporated herein by reference in their entirety.

TECHNICAL FIELD

This document relates generally to hearing aids and more particularly to a system and method for monitoring and adjusting short-range wireless communication in hearing aid systems.

BACKGROUND

Short-range wireless communication is used in hearing aid systems to provide for functions such as ear to ear synchronization, remote control, configuration, streaming audio, and bi-directional audio. Such short-range wireless communication may use radio frequency (RF) electromagnetic waves in frequency ranges that do not require a license to operate. Electromagnetic waves from other electronic devices in the vicinity of a hearing aid system may therefore interfere with the wireless communication in that hearing aid system. Thus, there is a need to ensure quality of wireless communication in hearing aid systems.

SUMMARY

A system collects information on performance of short-range wireless communication in local hearing aid systems. The information is analyzed, for example, to inform local users to adjust the local hearing aid systems, to adjust operational parameters for improving wireless communication in the local hearing aid systems, and/or to improve wireless connectivity and reliability in future products. In various embodiments, a local device collects the information from a local hearing system and transmits the collected information to a computer through a network. The computer stores and/or analyzes the information. In various applications the information collected can be used to determine improvements of the use of the overall system. In various applications the information collected can be used to make determinations about the wireless environments hearing aid systems are being used in.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a system for monitoring and analyzing performance of short-range wireless communication links in hearing aid systems. In various embodiments, such communication links may operate in unlicensed radio-frequency (RF) bands and allow for, for example, configuring hearing aids using wireless devices. Hearing aids may be configured and/or used in environments with substantial electromagnetic interference from various sources. Cognitive radio techniques are used to avoid harmful interference and/or prevent creation of interference for other devices. These cognitive radio techniques are applied to identify and reduce interference by modifying the operational parameters of each hearing aid system, such as carrier frequency, symbol rate, occupied bandwidth, time multiplexing, forward error correction, spreading codes, and hop sequences. One or more of these parameters are tunable based on the characteristics of the interference to ensure reliable wireless communication in the hearing aid system. The present system provides for information of such characteristics of the interference present in the environment of each hearing aid system by collecting and analyzing relevant data from that hearing aid system. By monitoring a wide range of situations in various environments, wireless communication links in hearing aid systems are optimized for best throughput and reliability.

Figure 1:
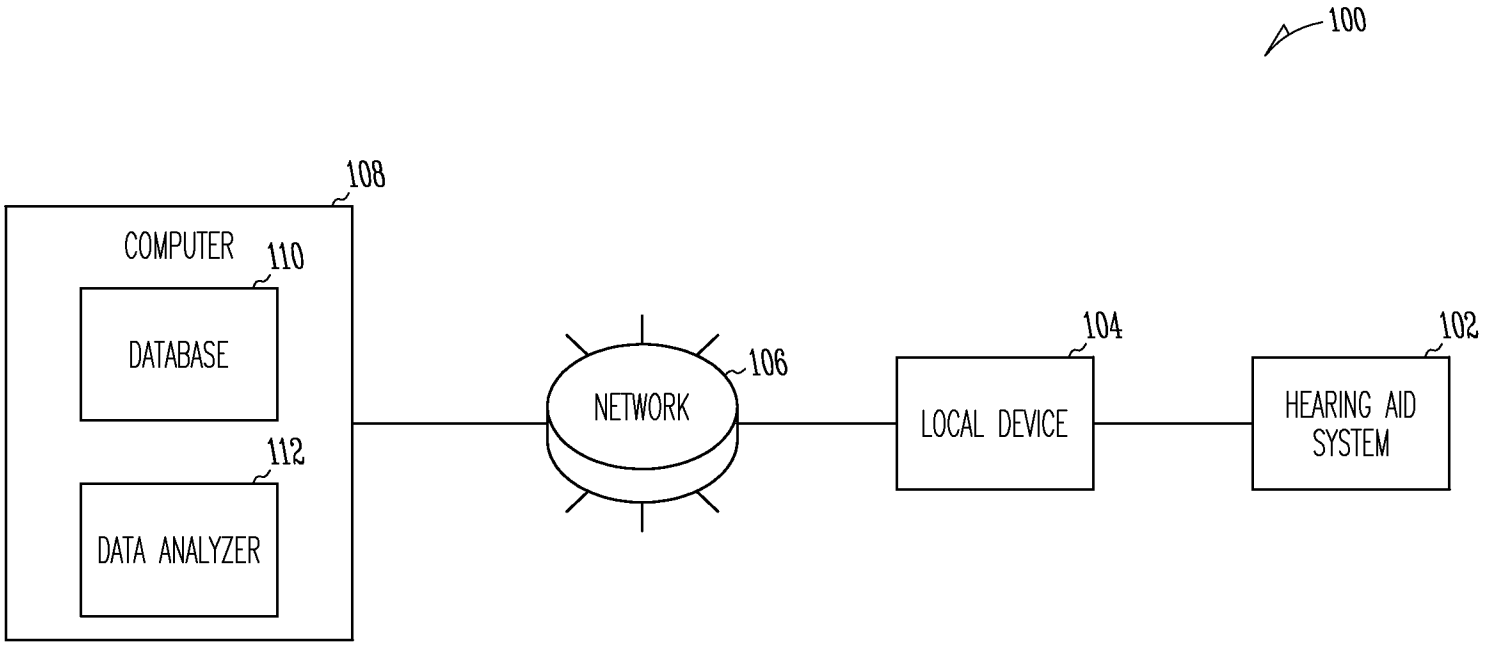
FIG. 1 is a block diagram illustrating an embodiment of a system for monitoring short-range communication in a hearing aid system.

FIG. 1 is a block diagram illustrating an embodiment of a system 100 for monitoring short-range communication in a hearing aid system. System 100 includes a hearing aid system 102, a local device 104, a network 106, and a computer 108. In various embodiments, system 100 allows for monitoring of short-range wireless communication in multiple local hearing aid systems through multiple local devices, as further discussed below with reference to FIG. 5.

In various embodiments, hearing aid system 102 includes multiple hearing aids communicatively coupled to each other via one or more short-range wireless communication links, or a hearing aid configuring device communicatively coupled to one or more hearing aids via one or more short-range wireless communication links. While some embodiments of hearing aid system 102 are discussed below with reference to FIGS. 2-4 for illustrative purposes, the present subject matter is applicable to any hearing aid systems in which short-range wireless communication is employed.

Local device 104 is communicatively coupled to hearing aid system 102. In various embodiments, local device 104 is a computer. In various applications that computer is executing a fitting software for hearing aids. In various embodiments, the computer is embodied in a personal computer. In various embodiments, the computer is embodied in a handheld personal device, such as a cell phone or personal digital assistant. In various embodiments, the personal computer is an iPad by Apple Computer of Cupertino, Calif. In various embodiments, local device 104 is a router. In various embodiments, local device 104 is a wireless communication point or node. In various embodiments, local device 104 includes one or more of the interface embodiments demonstrated in U.S. Provisional Patent Application Ser. No. 60/687,707, filed Jun. 5, 2005, entitled: COMMUNICATION SYSTEM FOR WIRELESS AUDIO DEVICES, and U.S. patent application Ser. No. 11/447,617, filed Jun. 5, 2006, entitled: COMMUNICATION SYSTEM FOR WIRELESS AUDIO DEVICES which claims the benefit of the provisional application, the entire disclosures of which are hereby incorporated by reference. In various embodiments, one or more of the hearing aids use the radio technology provided in Provisional Patent Application Ser. No. 60/687,707, and U.S. patent application Ser. No. 11/447,617, both of which are incorporated by reference in their entirety. In various embodiments a low power system is provided to allow communications between the configuring devices and one or more hearing aids.

Local device 104 allows for programming and reprogramming of hearing aid system 102, including its operational parameters controlling the short-range wireless communication, as well as data collection from hearing aid system 102, including information related to operation and performance of the short-range wireless communication. In one embodiment, local device 104 is coupled to hearing aid system 102 via wired connections such as Ethernet, USB, and FireWire. In another embodiment, local device 104 is coupled to hearing aid system 102 via wireless connections such as BlueTooth™, WiFi, and cellular network.

Local device 104 communicates with computer 108 through network 106. Network 106 can be a LAN, the INTERNET, some other telecommunications network, or combinations thereof. The network 106 provides computer 108 with access to information on hearing aid system 102 collected by local device 104, including information related to the short-range wireless communication. Computer 108 includes a database 110 that stores such information and a data analyzer 112 that analyzes such information. In various embodiments, computer 108 may be part of a hearing aid service facility that provides for services to users of hearing aids and their configuring devices. Examples of information collected by local device 104 and uploaded to database 110 include interference parameters such as the number of in-band and out-of-band interferers, frequencies of the interferers, levels of the interferers, extent to which a bandwidth is occupied by the interferers, and duration at which the interferers are present. The information may also include results of analyses of one or more of such interference parameters performed by local device 104. In various embodiments, local device 104 and/or data analyzer 112 analyze the information collected from hearing aid system 102, such as by generating statistics on one or more of the interference parameters.

In one embodiment, local device 104 and/or data analyzer 112 produce temporal statistics such as hop frequency, time slot allocation, and similar parameters related to the short-range wireless communication as indicators of how the bandwidth of the short-range wireless communication is being utilized and how to optimize the operation of the short-range wireless communication in the presence of the interferers. In one embodiment, such statistics are stored in database 110 and used to improve or optimize the short-range wireless communication in hearing aid system 102. For example, the information may be used to modify firmware that controls the media access control (MAC) and physical (PHY) layers of the local devices (such as devices 222, 322 and 422 as discussed below) and the hearing aids (such as hearing aids 224, 228, 324, 328, 424, and 428 as discussed below). In some embodiments, such statistics are used to provide a user such as an audiologist who operates hearing system 102 with information on how to ensure reliable communication between the configuration device and hearing aids. For example, the information is used to inform the user as to the reliability of the environment for the short-range wireless communication and suggest steps for the user to improve performance of the communication within hearing aid system 102. Examples of the suggestions include shortening the distance of the short-range wireless communication (such as between a hearing aid and its configuring device), using a different frequency band for the short-range wireless communication, and using wired communication when the interferences in the environment reach thresholds beyond the capability of the short-range wireless communication link(s) of hearing aid system 102.

Figure 2:
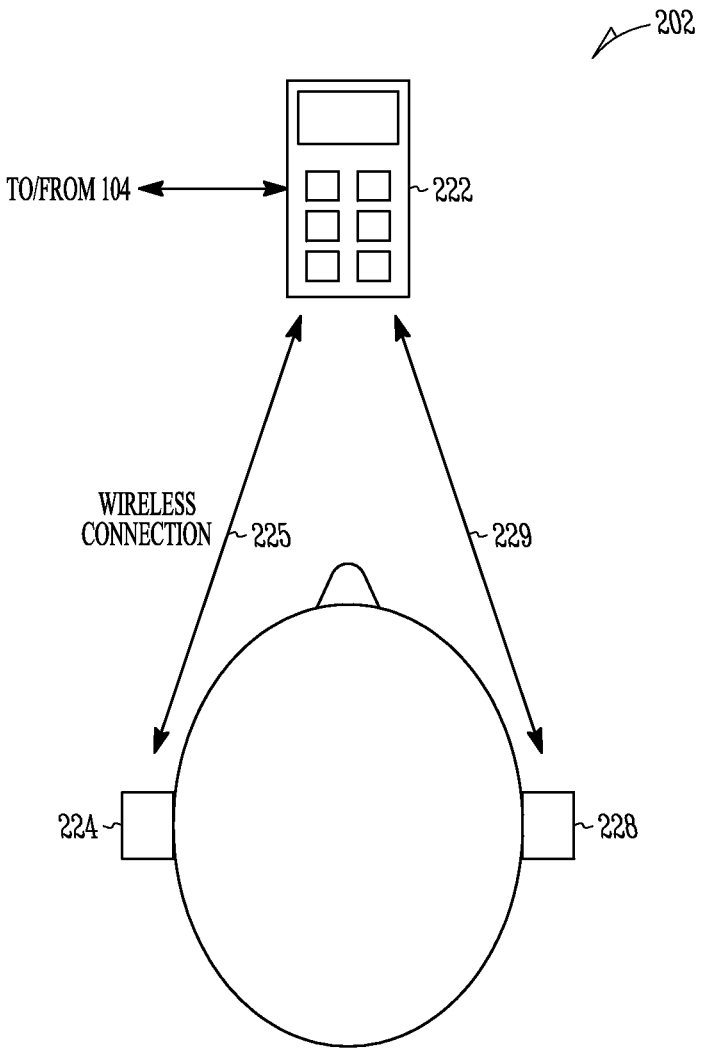
FIG. 2 is an illustration of an embodiment of a hearing aid system using wireless devices in a direct communication mode.

FIG. 2 is an illustration of an embodiment of a hearing aid system 202 using wireless devices in a direct communication mode. System 202, which represents an embodiment of system 102, uses wireless devices in a direct communication mode with a local device 222. Local device 222 transmits signals 225 to a first hearing aid 224 including first audio information. Local device 222 also transmits signals 229 to a second hearing aid 228 including second audio information. In this embodiment, first hearing aid 224 does not have a wireless connection to second hearing aid 228 for transmitting stereo information from first hearing aid 224 to second hearing aid 228. Thus, the first audio information is wirelessly received by first hearing aid 224 and played to a first ear of the wearer and second audio information is wirelessly received by second hearing aid 228 and played to the second ear of the wearer.

Figure 3:
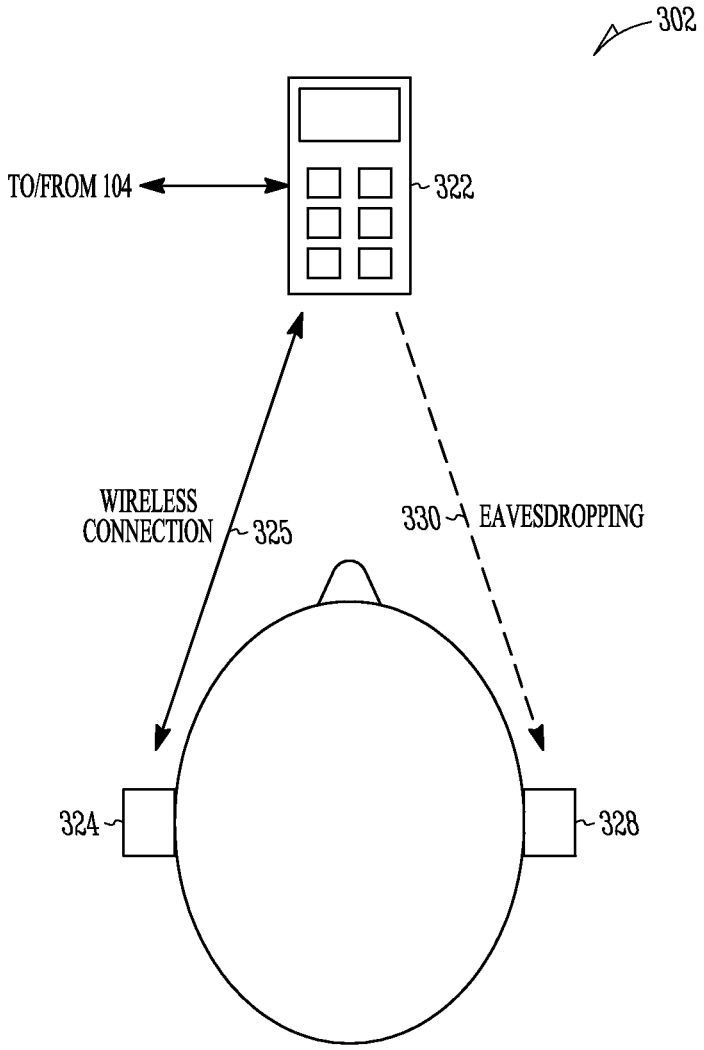
FIG. 3 is an illustration of an embodiment of a hearing aid system using wireless devices in an eavesdropping communication mode.

FIG. 3 is an illustration of an embodiment of a hearing aid system 302 using wireless devices in an eavesdropping communication mode. System 302, which represents another embodiment of system 102, in various embodiments supports eavesdropping modes. For example, as shown in FIG. 3, in system 302 local device 322 is in communications with a first hearing aid 324 via signals 325. A second hearing aid 328 can "listen in" on communications from local device 322 using a mode that is different than the mode used by first hearing aid 324. For instance, it is possible that second hearing aid 328 receives signals 330, but does not control, for example, handshaking with local device 322 to the same extent as first communication device 324. Other eavesdropping modes can be employed without departing from the scope of the present subject matter.

Figure 4:
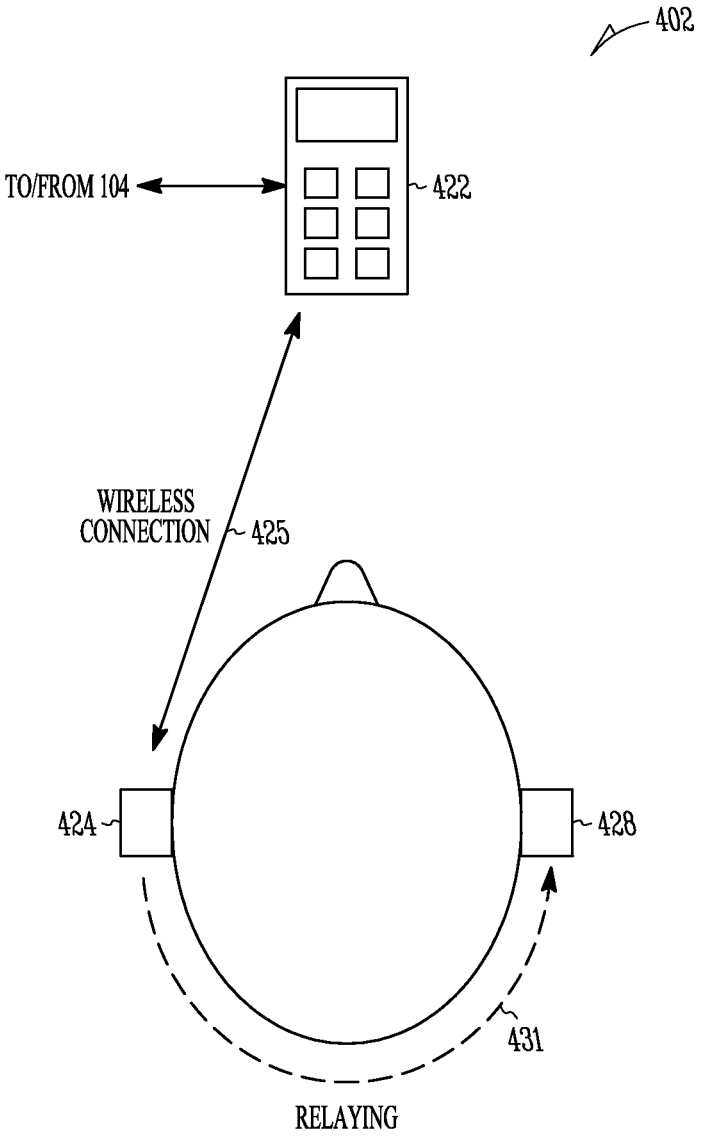
FIG. 4 is an illustration of an embodiment of a hearing aid system using wireless devices in a relaying communication mode.

FIG. 4 is an illustration of an embodiment of a hearing aid system 402 using wireless devices in a relaying communication mode. System 402 represents another embodiment of system 102. FIG. 4 depicts one embodiment where a relaying mode is employed to communicate wirelessly between a first hearing aid 424 and a second hearing aid 428. In this embodiment, first and second audio information is sent over signal 425 to first hearing aid 424. The second audio information is then relayed to second hearing aid 428 via relay signal 431. Such relay may be performed using different frequencies, different communication modes and with different data rates, for different implementations if desired. In one embodiment, first hearing aid 424 may demodulate and decode stereo information and encode and relay the channel bound for the instrument on or in the other ear. In various embodiments, the communications can be made using similar transmissions to the primary transmission. In various embodiments, the communications can be made using a different method than that of the primary transmission. In various embodiments, the signals 425 and 431 are unidirectional. In various other embodiments, the signals 425 and 431 are bidirectional. In various embodiments, the signals 425 and 431 are programmably combinations of unidirectional and/or bidirectional. Thus, the system 400 is highly programmable to adapt to a number of communication requirements and applications. In one embodiment, relay signal 431 is a substantially magnetically coupled or near field communication link. In one embodiment, a telecoil is employed to receive the relay signal 431. In one embodiment, a magnetic sensor is used to receive the relay signal 431. In one embodiment, relay signal 431 is an RF or far field communication link. Other communication links, such as infrared and ultrasonic may be employed in various applications.

In the various embodiments and applications provided herein, different communications electronics are used by the local hearing aid systems (e.g., 202, 302, and 402) to provide different communication modes for the stereo information. For example, in one embodiment a first channel and a second channel are employed to communicate the stereo information to the first and second ears, respectively. In one embodiment, the electronics includes frequency division multiplexed communications electronics. In one embodiment, the electronics includes time division multiplexed communications electronics. In one embodiment, the electronics includes code division multiplexed communications electronics. In one embodiment, the electronics includes packetized communications electronics. In one embodiment, the electronics includes analog communications electronics. In one embodiment, the electronics includes frequency modulated communications electronics. In one embodiment, the electronics includes single sideband communications electronics. In one embodiment, the electronics includes amplitude modulated communications electronics. In one embodiment, the electronics includes phase modulated communications electronics. Other modulation and communications embodiments are within the scope of the present subject matter and those examples provided herein are intended to demonstrate the flexibility and adaptability of the present subject matter.

The local hearing aid systems (e.g., 202, 302, and 402) in various embodiments can also support communications modes where the first audio information and the second audio information are the same or substantially the same audio information.

In various embodiments, the local device (e.g., 222, 322, and 422) supports one or more communication protocols. In various embodiments, communications of far field signals are supported. Some embodiments employ 2.4 GHz communications. In various embodiments the wireless communications can include standard or nonstandard communications. Some examples of standard wireless communications include, but are not limited to, FM, AM, SSB, BlueTooth™, IEEE 802.11 (wireless LANs) WiFi, 802.15 (WPANs), 802.16 (WiMAX), 802.20, and cellular protocols including, but not limited to CDMA (code division multiple access) and GSM, ZigBee, and ultra-wideband (UWB) technologies. Such protocols support radio frequency communications and some support infrared communications. Other available forms of wireless communications include ultrasonic, optical, and others. It is understood that the standards which can be used include past and present standards. It is also contemplated that future versions of these standards and new future standards may be employed without departing from the scope of the present subject matter.

Such local devices (e.g., 222, 322, and 422) include, but are not limited to, cellular telephones, personal digital assistants, personal computers, streaming audio devices, wide area network devices, local area network devices, personal area network devices, and remote microphones. In various embodiments, the local device includes one or more of the interface embodiments demonstrated in U.S. Provisional Patent Application Ser. No. 60/687,707, filed Jun. 5, 2005, entitled: COMMUNICATION SYSTEM FOR WIRELESS AUDIO DEVICES, and U.S. patent application Ser. No. 11/447,617, filed Jun. 5, 2006, entitled: COMMUNICATION SYSTEM FOR WIRELESS AUDIO DEVICES which claims the benefit of the provisional application, the entire disclosures of which are hereby incorporated by reference. In various embodiments, one or more of the hearing aids use the radio technology provided in Provisional Patent Application Ser. No. 60/687,707, and U.S. patent application Ser. No. 11/447,617, both of which are incorporated by reference in their entirety. In various embodiments a low power system is provided to allow communications between the local devices and one or more hearing aids.

In the embodiments demonstrated herein, the wearer has first and second hearing aids. In various embodiments, such devices include, but are not limited to, various types of hearing aids. In one embodiment, at least one wireless hearing assistance device is a behind-the-ear hearing aid. In one embodiment, at least one wireless hearing assistance device is an in-the-ear hearing aid. In one embodiment, at least one wireless hearing assistance device is a completely-in-the-canal hearing aid. In various embodiments, at least one wireless hearing assistance device is a receiver-in-the-canal device (RIC, also known as a receiver-in-the-ear or RITE type device). In one embodiment, at least one wireless hearing assistance device is a wireless earpiece. Various examples of wireless adapters for some hearing assistance devices using a direct-audio input (DAI) interface are demonstrated in U.S. patent application Ser. No. 11/207,591, filed Aug. 18, 2005, entitled "WIRELESS COMMUNICATIONS ADAPTER FOR A HEARING ASSISTANCE DEVICE;" and PCT Patent Application No. PCT/US2005/029971, filed Aug. 18, 2005, entitled "WIRELESS COMMUNICATIONS ADAPTER FOR A HEARING ASSISTANCE DEVICE," the entire disclosures of which are incorporated by reference.

The wireless hearing aids can contain a microphone to receive sounds. Some examples include a microphone for reception of ambient sound, which can be encoded and transmitted by the wireless hearing assistance device. Another example is a microphone adapted for reception of speech by the wearer of the device. The speech can be encoded and transmitted by the wireless hearing assistance device. It is understood that in certain embodiments, the wireless hearing aids may be wireless hearing assistance devices. One type of hearing assistance device is a hearing aid. Other wireless communication devices may be employed having various information to communicate. Thus, the devices can support bidirectional communication modes.

In various embodiments, the communications between the configuring device and one or more wireless communication devices are unidirectional. In various embodiments, the communications between the configuring device and one or more wireless communication devices are bidirectional. In various embodiments, the communications include at least one unidirectional communication and one bidirectional communication. Thus, the system is highly programmable to adapt to a number of communication requirements and applications. In relaying embodiments, it is understood that the communications can be unidirectional or bidirectional.

FIGS. 2-4 illustrate, by way of example, and not by way of limitation, various local hearing aid systems employing short-range wireless communication links. Such short-range wireless communication links as illustrated in FIGS. 2-4 include the wireless communication link between local device 222 and hearing aid 224 for transmitting signals 225, the wireless communication link between local device 222 and hearing aid 228 for transmitting signals 229, the wireless communication link between local device 322 and hearing aid 324 for transmitting signals 325, the wireless communication link from local device 322 to hearing aid 328 for transmitting signals 330, the wireless communication link between local device 422 and hearing aid 424 for transmitting signals 425, and the wireless communication link between hearing aid 424 and hearing aid 428 for relaying signals 431. In various embodiments, local hearing aid system 102, including its various embodiments, employs any one or more short-range wireless communication links. System 100 provides for monitoring and analyzing the environment and performance of the one or more short-range wireless communication links to provide information allowing for improvement or optimization of their performance.

Figure 5:
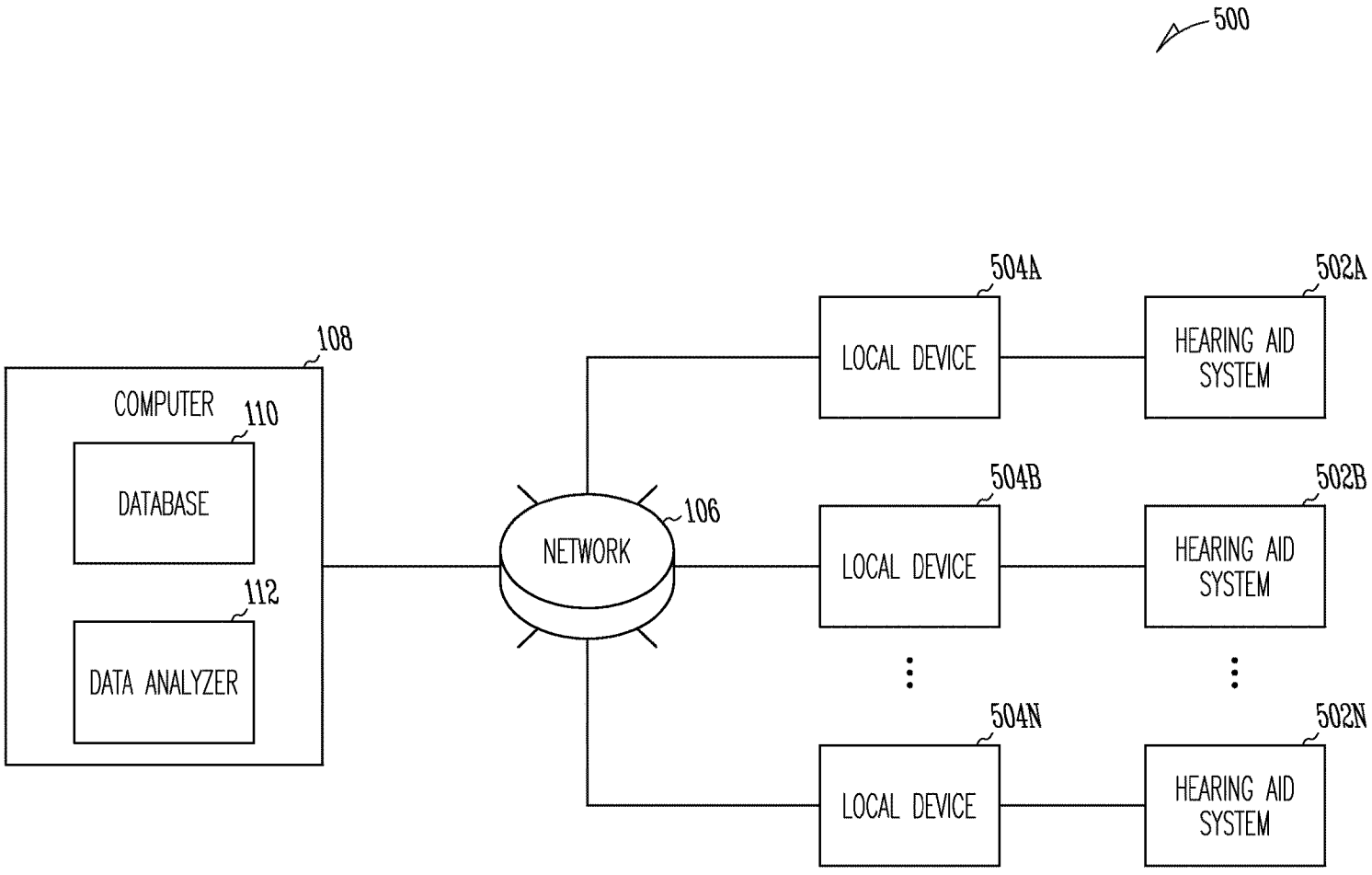
FIG. 5 is a block diagram illustrating an embodiment of a system for monitoring short-range communication in multiple local hearing aid systems.

FIG. 5 is a block diagram illustrating an embodiment of a system 500 for monitoring short-range communication in multiple local hearing aid systems. System 500 represents an embodiment of system 100 with computer 108 communicating with local hearing aid systems 502A-M through local devices 504A-N. A plurality of local hearing aid systems 502A-M each employs one or more short-range wireless communication links. Examples for each of local hearing aid systems 502A-M include, but are not limited to, systems 202, 302, and 402. Local devices 504A-N are each communicatively coupled to one or more systems of local hearing aid systems 502A-M. In various embodiments, local computers 504A-N allow for programming and reprogramming of local hearing aid system 502A-M, including their operational parameters controlling the short-range wireless communication, as well as data collection from local hearing aid systems 502A-M, including information related to operation and performance of the short-range wireless communication links. In various embodiments, local computer 504A-N are each coupled to one or more of local hearing aid systems 502A-M via wired connections such as Ethernet, USB, and FireWire and/or wireless connections such as BlueTooth™, WiFi, and cellular network. Local computers 504A-N communicate with computer 108 through network 106 as set forth herein.

In various embodiments, information collected and analyzed by system 100 or 500 allows for notification of an operator of a local hearing aid system such as system 102 or one of system 502A-M that a shorter range may be necessary to reliably communicate with the wearer's hearing aids using a local device. When the environmental interference is beyond the tolerability of a local hearing aid system, the user is notified that wired communication may be necessary for reliable configuration of the hearing aids.

In various embodiments, information collected and analyzed by system 100 or 500 provides bases for modifying operational parameters related to the short-range wireless communication in each local hearing aid system, including frequency bands, modulation type, symbol rate, spreading codes, and/or any other operational parameter that may improve performance of the short-range wireless communication.

In various embodiments, information collected and analyzed by system 100 or 500 provides bases for improving performance of short-range wireless communication in future products including hearing aids, configuring devices, and/or any other components of the local hearing aid systems.

In various applications, the computer 108 can be used to instruct the operator of local device 104 to change communications with the hearing aids 102 based on information received by computer 108. In some applications a fitting professional might be instructed to change fitting parameters or to perform a wired connection to improve communications with hearing aids 102. Such examples are demonstrative and not intended in an exhaustive or limiting sense. Other applications and uses are possible without departing from the scope of the present subject matter.

In various embodiments, the information collected and analyzed by system 100 or 500 includes interference parameters associated with unused channels in the short-range wireless communication. The information is analyzed to generate statistics with respect to, for example, interference levels, duty cycles, modulation methods, and amplitudes that are encountered by the unused channels. The statistics are used to adjust MAC and PHY layer parameters for improving wireless connectivity and reliability of the short-range wireless communication, and/or for improving wireless connectivity and reliability in future products.

In various embodiments, the information collected and analyzed by system 100 or 500 is statistically analyzed. The resulting statistics are used to provide a user of a local hearing aid system with information related to the health of the wireless communication in that local hearing aid system and recommendation for adjustments. Examples of such recommendations include range of communication to be expected, band to be used, and whether wireless communication should be used.

In various embodiments, the information collected and analyzed by system 100 or 500 includes packet errors, retries, FEC errors, and throughput. The results of the analysis are used to modify and improve the short-range wireless communication. The modification and improvement may include adjustment of MAC and PHY layer parameters for improving wireless connectivity and reliability in existing local hearing aid systems and/or in future products.

In various embodiments, the information collected and analyzed by system 100 or 500 includes interference parameters associated with active and unused channels of the short-range wireless communication. The interference parameters are statistically analyzed to determine whether the environment in which a local hearing aid system operates is suitable for wireless communication. The results are used to provide the user of the local hearing aid system with information regarding the health of the wireless communication and/or a recommendation on whether wired communication should be used for this environment.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A system for monitoring short-range wireless communication including a channel map in a local hearing aid system including one or more hearing aids, the monitoring system comprising;

a local device configured to be communicatively coupled to at least one of the one or more hearing aids, the local device including a first processor and configured to collect information related to performance of the short-range wireless communication with the at least one hearing aid;

a network; and a second processor communicatively coupled to the local device through the network and configured to receive, store, and analyze the information related to performance of the short-range wireless communication, wherein the information is used to select a set of hop frequencies from the channel map.

2. The system of claim 1, wherein the information includes packet errors.

3. The system of claim 1, wherein the information includes retries.

4. The system of claim 1, wherein the information includes FEC errors.

5. The system of claim 1, wherein the information includes throughput.

6. The system of claim 1, wherein the information is used to provide bases for modifying an operational parameter related to the short-range wireless communication.

7. The system of claim 6, wherein the operation parameter includes frequency band.

8. The system of claim 6, wherein the operation parameter includes modulation type.

9. The system of claim 6, wherein the operation parameter includes symbol rate.

10. The system of claim 6, wherein the operation parameter includes spreading codes.

11. The system of claim 1, wherein the short-range wireless communication includes radio frequency communication.

12. A method, comprising:

monitoring a short-range wireless communication system including a channel map in a local hearing aid system using a local device that includes a first processor, including collecting information related to performance of the short-range wireless communication using the local device, the short-range wireless communication including wireless communication with at least one hearing aid of the local hearing aid system;

transmitting the information from the local device to a second processor using a network, the second processor separate from the local device;

storing and analyzing the information using the second processor; and using the information to select a set of hop frequencies from the channel map to improve performance of the short-range wireless communication system.

13. The method of claim 12, wherein monitoring short-range wireless communication in a local hearing aid system using a local device includes communicatively coupling the local device to a first hearing aid in a first ear.

14. The method of claim 13, wherein monitoring short-range wireless communication in a local hearing aid system using a local device includes communicatively coupling the local device to a second hearing aid in a second ear.

15. The method of claim 14, wherein monitoring short-range wireless communication in a local hearing aid system includes using the second hearing aid to eavesdrop on the local device and the first hearing aid.

16. The method of claim 13, wherein monitoring short-range wireless communication in a local hearing aid system using a local device includes communicatively coupling the first hearing aid in the first ear to a second hearing aid in the second ear.

17. The method of claim 12, wherein using the information to improve performance of the short-range wireless communication system includes notifying a user of a local hearing aid system to use a shorter range to communicate with the local hearing aid system using the local device.

18. The method of claim 12, wherein using the information to improve performance of the short-range wireless communication system includes, when environmental interference is determined to be beyond tolerability of the local hearing aid system, notifying a user of the local hearing aid system to switch to wired communication between the local device and the local hearing aid system.

19. The method of claim 12, wherein using the information to improve performance of the short-range wireless communication system includes using the information to modify operational parameters related to the short-range wireless communication.

20. The method of claim 12, wherein using the information to improve performance of the short-range wireless communication system includes using the information to improve performance of the short-range wireless communication between hearing aids, configuring devices, and/or any other components of the local hearing aid systems.

* * * * *